US005991556A

United States Patent [19]

Yamashita

[11] Patent Number: 5,991,556

[45] Date of Patent: Nov. 23, 1999

[54] SHEET FEEDING METHOD FOR IMAGE FORMATION APPARATUS HAVING A SHEET TRANSPORT PATH FOR ONE SHEET CASSETTE SERVING AS A PORTION OF A SHEET TRANSPORT PATH FOR ANOTHER SHEET CASSETTE

[75] Inventor: Hiroshi Yamashita, Yamatokoriyama, Japan

[73] Assignee: Sharp Kabushiki Kaisha, Osaka, Japan

[21] Appl. No.: 09/136,403

[22] Filed: Aug. 19, 1998

[30] Foreign Application Priority Data

Aug. 27, 1997 [JP] Japan ..... 9-230781

[51] Int. Cl.[6] ..... B65H 3/44; G03G 15/00

[52] U.S. Cl. ..... 399/23; 271/9.03; 271/9.06; 399/391

[58] Field of Search ..... 399/23, 391, 16, 399/81, 82, 85; 271/9.02, 9.03, 9.13, 256, 258.01, 259, 9.06

[56] References Cited

U.S. PATENT DOCUMENTS

| | | | |
|---|---|---|---|
| 4,484,734 | 11/1984 | Tsudaka et al. | 271/9.03 |
| 4,966,356 | 10/1990 | Ohyabu et al. | 271/9.06 X |
| 5,061,958 | 10/1991 | Bunker et al. | 399/81 |
| 5,155,537 | 10/1992 | Komatsu et al. | 399/391 |
| 5,785,308 | 7/1998 | Flores et al. | 271/9.11 |

FOREIGN PATENT DOCUMENTS

| | | |
|---|---|---|
| 0310060A2 | 4/1989 | European Pat. Off. . |
| 0448068A2 | 9/1991 | European Pat. Off. . |
| 2758495 | 7/1998 | France . |
| 4-123072 | 4/1992 | Japan . |
| 5-309891 | 11/1993 | Japan . |
| 2216501 | 10/1989 | United Kingdom . |

OTHER PUBLICATIONS

Patent Abstracts of Japan, JP 10207299 A, Image Forming Device and Method Therefor, Aug. 7, 1998.

*Primary Examiner*—Sandra Brase
*Assistant Examiner*—Sophia S. Chen
*Attorney, Agent, or Firm*—Birch, Stewart, Kolasch & Birch, LLP

[57] ABSTRACT

According to a sheet feeding method capable of successive image formation for use in an image formation apparatus with a sheet transport path for an upper sheet feeding cassette also serving as a portion of a sheet transport path for a lower sheet feeding cassette, the lower sheet feeding cassette initially starts feeding sheets. When the lower sheet feeding cassette runs out of sheets, a request is signaled to resupply sheets to the lower sheet feeding cassette and the upper sheet feeding cassette feeds sheets. When the lower sheet feeding cassette is resupplied with sheets, the lower sheet feeding cassette resumes feeding sheets.

11 Claims, 6 Drawing Sheets

SHEET FEEDING METHOD FOR IMAGE FORMATION APPARATUS HAVING A SHEET TRANSPORT PATH FOR ONE SHEET CASSETTE SERVING AS A PORTION OF A SHEET TRANSPORT PATH FOR ANOTHER SHEET CASSETTE

BACKGROUND OF THE INVENTION

1. Field of the Invention

The invention relates to a sheet feeding method for image formation apparatuses, such as printers, facsimile, copiers, having a plurality of cassettes with a transport path for the sheets stored in an upper cassette also serving as a portion of a transport path for the sheets stored in a lower cassette.

2. Description of the Background Art

A conventional image formation apparatus has a sheet transport path for an upper sheet cassette also serving as a sheet transport path for a lower sheet cassette. In the image formation apparatus, the lower cassette initially feeds sheets, and when the sheet of the lower cassette run out, the upper cassette then feeds sheets. The lower cassette resumes feeding sheets when the lower cassette is resupplied with sheets with the upper cassette feeding sheets. Thus sheets are fed successively.

However, the image formation apparatus has a disadvantage that insertion or exit of the upper cassette into or from the body of the apparatus while the lower cassette is feeding sheets results in jam of the sheets being transported from the lower cassette and thus lowers image formation efficiency. In order to overcome the disadvantage, the sheet feed device of the image formation apparatus disclosed in U.S. Pat. No. 5,155,537 prohibits insertion and exit of the upper cassette while the lower sheet feeding cassette is feeding sheets. Otherwise the sheet feed device is provided with signaling means for signaling to the user whether insertion and exit of the upper cassette is allowed.

For the sheet feed device described above, however, the upper cassette cannot be resupplied with sheets while the lower cassette is feeding sheets. Thus, successive image forming operations cannot be effected when sheet feeding is switched from the lower cassette emptied to the upper cassette that does not contain any sheets.

Furthermore, if the user does not notice that the sheets of the lower cassette run out and fails to resupply the lower cassette with sheets while the upper cassette has sheets and is feeding them, the current image forming operation is terminated when the sheets of the upper cassette run out.

SUMMARY OF THE INVENTION

The present invention has been made to overcome the above disadvantages and contemplates a sheet feeding method for an image formation apparatus having a sheet transport path for an upper sheet feeding cassette also serving as a portion of a sheet transport path for a lower sheet feeding cassette wherein successive image formation can be provided without interrupting an image forming operation when sheets run out.

The present invention also contemplates a sheet feeding method for an image formation apparatus having a sheet transport path for an upper sheet feeding cassette also serving as a portion of a sheet transport path for a lower sheet feeding cassette, wherein successive image formation without interruption of an image forming operation when sheets run out can be provided when the size of an image is the same as that of the sheets in the upper sheet feeding cassette rather than that of the sheets in the lower sheet feeding cassette.

The present invention also contemplates a sheet feeding method for an image formation apparatus having a sheet transport path for an upper sheet feeding cassette also serving as a portion of a sheet transport path for a lower sheet feeding cassette, wherein successive image formation without interruption of an image forming operation when sheets run out can be provided when the upper sheet feeding cassette fails to previously contain a sufficient number of sheets.

The sheet feeding method according to an aspect of the present invention includes upper and lower sheet feeding cassettes for storage of sheets, first and second sensors for detecting the respective amounts of sheets remaining in the upper and lower sheet feeding cassettes, an electrophotography processing portion for forming an image on a sheet, an operation panel for notifying the operator of request and receiving an indication from the operator, and a printer control unit for control of selecting one of the upper and lower sheet feeding cassettes and supplying the sheets stored in the selected cassette to the electrophotography processing portion, wherein the upper sheet feeding cassette cannot be supplied with sheets while the sheets stored in the lower sheet feeding cassette are being fed to the electrophotography processing portion. The sheet feeding method includes the steps of: feeding sheets from the lower sheet feeding cassette when the size of the sheets stored in the upper sheet feeding cassette and that of the sheets stored in the lower sheet feeding cassette are both the same as that of an image; signaling a request to resupply sheets to the lower sheet feeding cassette and feeding sheets from the upper sheet feeding cassette when the lower sheet feeding cassette runs out of sheets; and feeding sheets again from the lower sheet feeding cassette when the lower sheet feeding cassette is resupplied with sheets after the signaling of the request to resupply the lower sheet feeding cassette with sheets.

The image formation apparatus allows the upper sheet feeding cassette to feed sheets when the lower sheet feeding cassette runs out of sheets. The image formation apparatus signals to the operator a request to resupply the lower sheet feeding cassette with sheets while the upper sheet feeding cassette is feeding sheets. When the lower sheet feeding cassette is resupplied with sheets, the cassette for feeding sheets is switched from the upper sheet feeding cassette to the lower sheet feeding cassette and the lower sheet feeding cassette thus again feeds sheets. Thus, feeding sheets from the lower sheet feeding cassette is prioritized, and a request to resupply sheets to the lower sheet feeding cassette is signaled to the operator when the lower sheet feeding cassette is allowed to be resupplied with sheets. Thus, sheets can be fed successively until the upper and lower sheet feeding cassettes completely run out of sheets. Also, the operator can rapidly resupply the lower sheet feeding cassette with sheets.

When the size of an image is the same as that of the sheets stored in the upper sheet feeding cassette rather than that of the sheets stored in the lower sheet feeding cassette, preferably the method further includes the step of signaling a request to change the sheets stored in the lower sheet feeding cassette to sheets of the same size as the image, feeding sheets from the upper sheet feeding cassette, and feeding sheets from the lower sheet feeding cassette when the lower sheet feeding cassette is resupplied with sheets of the same size as the image.

When image data is the same in size as the upper sheet feeding cassette rather than the lower sheet feeding cassette, the upper sheet feeding cassette feeds sheets. Simultaneously a request is signaled to change the lower sheet feeding cassette to a cassette of the same size as the image data. When the lower sheet feeding cassette is changed to a cassette of an appropriate size, the lower sheet feeding cassette feeds sheets. Since the request to change the lower sheet feeding cassette is signaled when the lower sheet feeding cassette is allowed to be changed, the image formation apparatus can feed sheets successively.

Still preferably the method further includes the steps of: signaling that the upper sheet feeding cassette feeds sheets when the lower sheet feeding cassette runs out of sheets and requesting an acknowledgement from the operator when the number of the sheets stored in the lower sheet feeding cassette is lower than a predetermined number with the lower sheet feeding cassette feeding sheets; and feeding sheets from the upper sheet feeding cassette when the lower sheet feeding cassette runs out of sheets, if the operator has acknowledged on the operation panel that the upper sheet feeding cassette feeds sheets.

The image formation apparatus with the lower sheet feeding cassette containing the number of sheets lower than the predetermined number of sheets signals that the upper sheet feeding cassette feeds sheets when the lower sheet feeding cassette runs out of sheets. If the operator acknowledges that the upper sheet feeding cassette feeds sheets, the upper sheet feeding cassette feeds sheets. If the operator does not acknowledge that the upper sheet feeding cassette feeds sheets, the current image forming operation is stopped when the lower sheet feeding cassette runs out of sheets.

When the lower sheet feeding cassette runs out of sheets, the upper sheet feeding cassette starts to feed sheets. If the operator acknowledges that the upper sheet feeding cassette feeds sheets, the operator can resupply the lower sheet feeding cassette with sheets when the lower sheet feeding cassette runs out of sheets. When the lower sheet feeding cassette is resupplied with sheets, the lower sheet feeding cassette resumes feeding sheets. Thus, the shorter the time required for resupplying the lower sheet feeding cassette with sheets, the less number of sheets fed from the upper sheet feeding cassette is required. This increases the number of sheets that can be fed successively.

Still preferably, the step of feeding sheets from the lower sheet feeding cassette when the size of the sheets stored in the upper sheet feeding cassette and that of the sheets stored in the lower sheet feeding cassette are both the same as that of an image includes the steps of: determining whether the upper sheet feeding cassette contains at least a predetermined number of sheets when the size of an image is the same as that of the sheets stored in the upper sheet feeding cassette and that of the sheets stored in the lower sheet feeding cassette; signaling to supply the upper sheet feeding cassette with sheets when the upper sheet feeding cassette contains less than the predetermined number of sheets; determining whether the upper sheet feeding cassette has been supplied with sheets; and feeding sheets from the lower sheet feeding cassette when the upper sheet feeding cassette is supplied with sheets, a predetermined time elapses after signaling to supply the upper sheet cassette with sheets, or when decision is made that the upper sheet feed cassette contains at least the predetermined number of sheets.

The number of the sheets remaining in the upper sheet feeding cassette is detected before the lower sheet feeding cassette feeds sheets. If the upper sheet feeding cassette contains less than a predetermined number of sheets, a request is signaled to supply the upper sheet feeding cassette with sheets. Thus, a sufficient number of sheets can be stored in the upper sheet feeding cassette prior to image formation.

The image formation apparatus allows the lower sheet feeding cassette to feed sheets, and allows the upper sheet feeding cassette to feed sheets when the lower sheet feeding cassette runs out of sheets. When the lower sheet feeding cassette is supplied with sheets with the upper sheet feeding cassette feeding sheets, the lower sheet feeding cassette resumes feeding sheets. However, the upper sheet feeding cassette cannot be supplied with sheets while the lower sheet feeding cassette is feeding sheets. Accordingly, the number of sheets that can be successively fed can be increased by previously storing a sufficient number of sheets in the upper sheet feeding cassette, as described above.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

An embodiment will now be described with a sheet feeding method for a sheet feed device of the present invention applied to an image formation apparatus. A laser printer as the image formation apparatus is interconnected to a host computer as an information processing device via a communication cable and the image data processed by the host computer is transmitted to the laser printer for image formation. Together with the image data, an indication and the like from the user at the host computer is transmitted as a control command via the communication cable to the laser printer, which operates according to such a control command.

Figure 1:
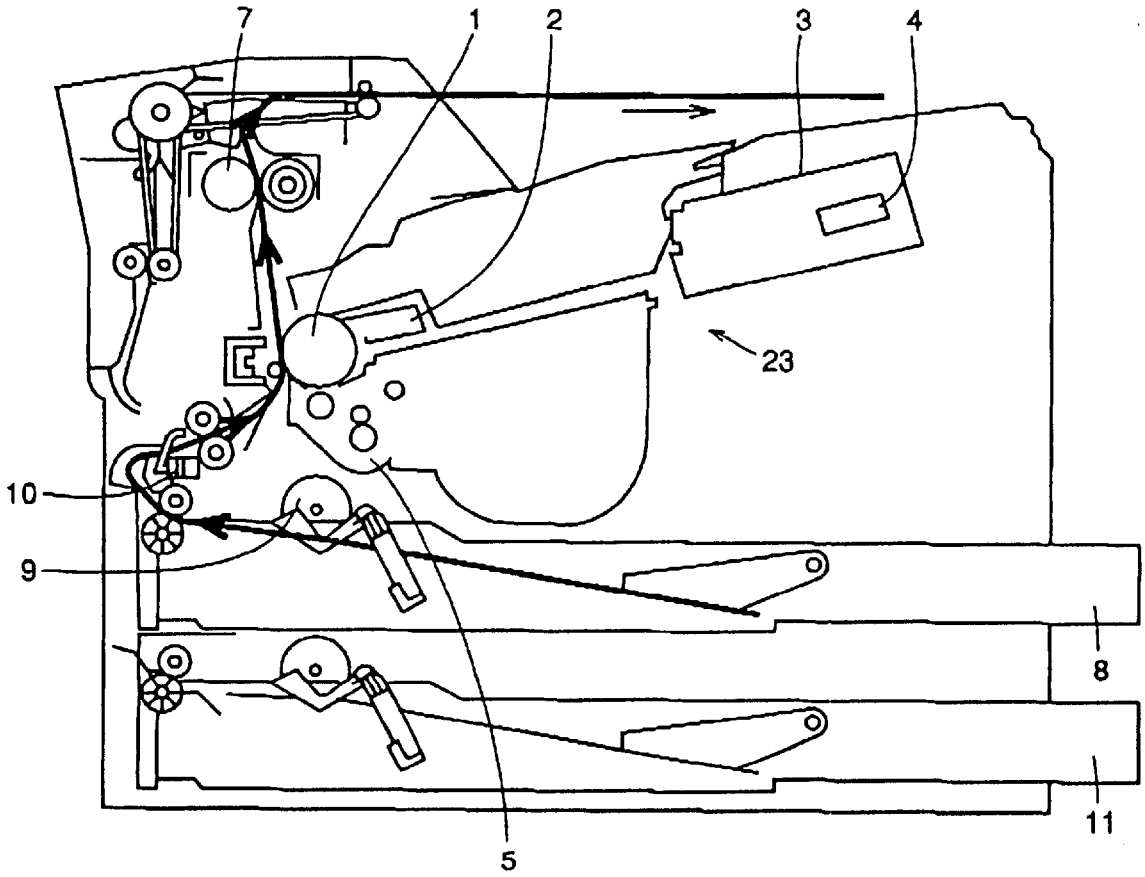
FIG. 1 is a schematic cross section of a laser printer as an embodiment of the present invention.

Referring to FIG. 1, the laser printer includes an electrophotography processing portion 23 for providing an electrophotography process. Electrophotography processing portion 23 includes a photoreceptor drum 1, a main charger 2 which charges a surface of photoreceptor drum 1, a laser light optical system 3 which emits laser light modulated depending on the image data, a polygon mirror 4 which rotates and thus reflects laser light to allow the laser light to scan the surface of photoreceptor drum 1, a developing unit 5 which develops with toner an electrostatic latent image formed on the photoreceptor drum 1 surface through exposure to laser light to render the electrostatic latent image a visible image, a fixation unit 7 which applies heat or pressure to the visible image to fix the image on a sheet, and the like.

The laser printer also includes an upper sheet cassette 8 positioned under the body of the laser printer for feeding sheets, a pickup roller 9 picking up the sheets in upper sheet feeding cassette 8 one by one, and a pin sensor 10 detecting an edge of a sheet fed via a sheet feeding roller (not shown) for measuring the number of sheets from the accumulation level of the sheets in cassette 8.

The rotation of a register roller (not shown) is controlled depending on the result detected by pin sensor 10. Associated with the control, a sheet is fed synchronously with image formation on photoreceptor drum 1 by laser light optical system 3.

A lower sheet feeding cassette 11 provided under upper sheet feeding cassette 8 feeds sheets in a manner similar to upper sheet feeding cassette 8. However, a sheet transport path for upper sheet feeding cassette 8 also serves as a portion of a sheet transport path for lower sheet feeding cassette 11. Thus, lower sheet feeding cassette 11 cannot feed sheets when upper sheet feeding cassette 8 is not mounted to the body.

A schematic configuration of each block of a control system provided for controlling an operation of each configuration described above will now be described with reference to FIG. 2.

Figure 2:
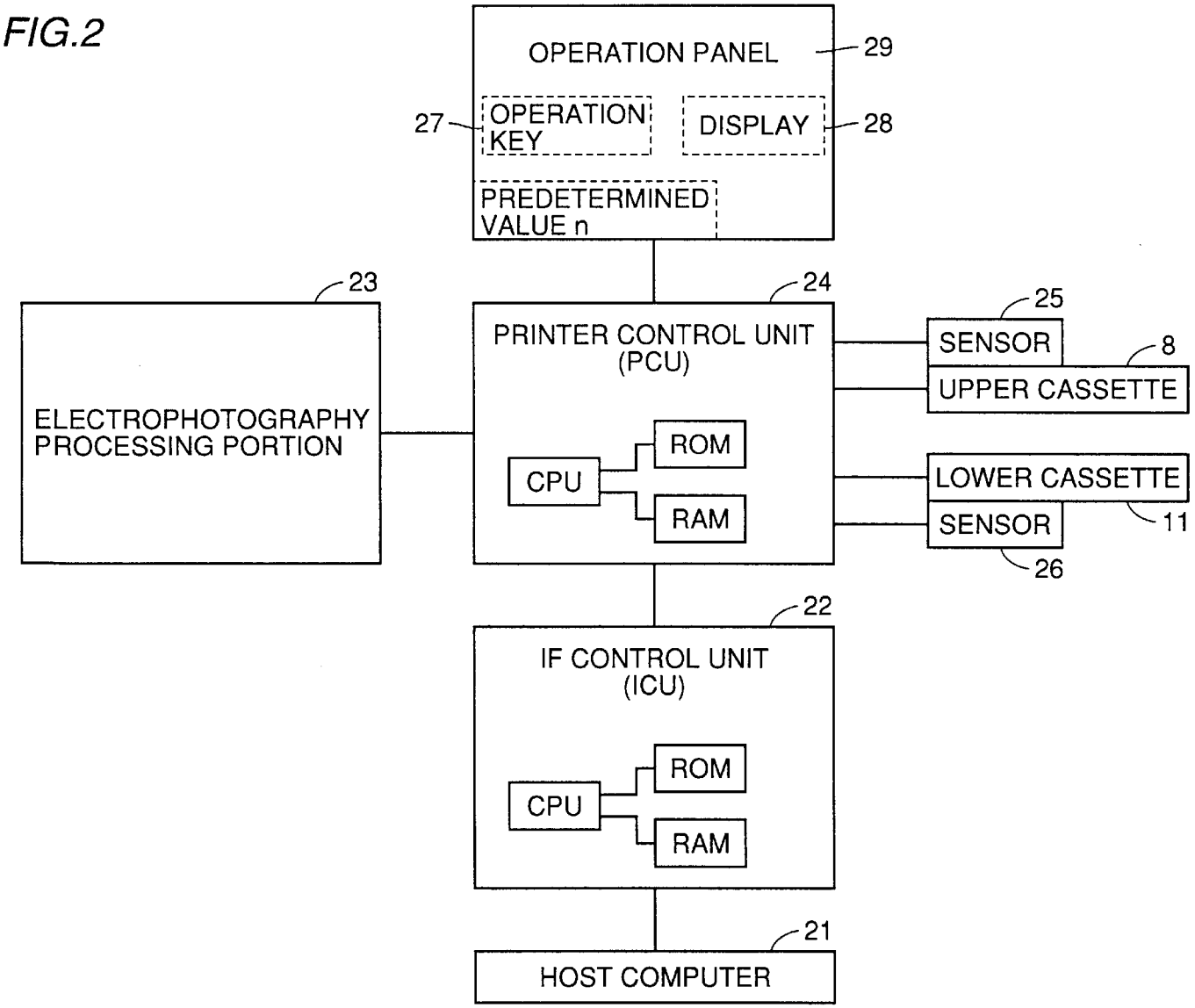
FIG. 2 is a block diagram of a control system of the laser printer as the embodiment of the present invention.

Referring to FIG. 2, the laser printer also includes an interface control unit (ICU) 22 which receives and analyzes the image data, control command and the like transmitted from host computer 21, a printer control unit (PCU) 24 which controls the operation of the entirety of the laser printer including electrophotography processing portion 23, upper and lower sensors 25 and 26 which detect the respective sizes and amounts of the sheets respectively stored in upper and lower sheet feeding cassettes 8 and 11, an operation key 27 for e.g. setting a predetermined value, and an operation panel 29 including a display 28 for e.g. displaying messages.

ICU 22 and PCU 24 are each a control circuit configured mainly of a central processing unit (CPU), a read-only memory (ROM) and a random access memory (RAM). As has been described above, PCU 24 is connected to upper and lower sheet feeding cassettes 8 and 11, upper and lower sensors 25 and 26, operation panel 29, electrophotography processing portion 23 and the like to control the operation of the entirety of the engine of the laser printer.

PCU 24 confirms whether upper and lower sheet feeding cassettes 8 and 11 have each run out of sheets, and the amount of sheets remaining in each of cassettes 8 and 11. PCU 24 also detects and transmits to ICU 22 that the states of upper and lower sensors 25 and 26 have changed, such as change in sheet size.

PCU 24 also transmits the information provided through operation of operation panel 29 to ICU 22 and the value of the information is stored in ICU 22. A predetermined value n (described later) referred to in the present invention that is related to the amount of remaining sheets is displayed on display 28. The value is set via operation key 27 on operation panel 29. The value is stored in ICU 22 via PCU 24, as described above.

Briefly describing, ICU 22 receives and analyzes the data transmitted from host computer 21 and forms image data. ICU 22 also obtains various information on the engine from PCU 24 and makes an inquiry with respect to the various information to determine which cassette to feed sheets. ICU 22 also requests PCU 24 to form (print) an image. ICU 22 also requests PCU 24 to display a message on display 28 of operation panel 29.

An operation example of the laser printer will now be described with reference to the figures.

Figure 3:
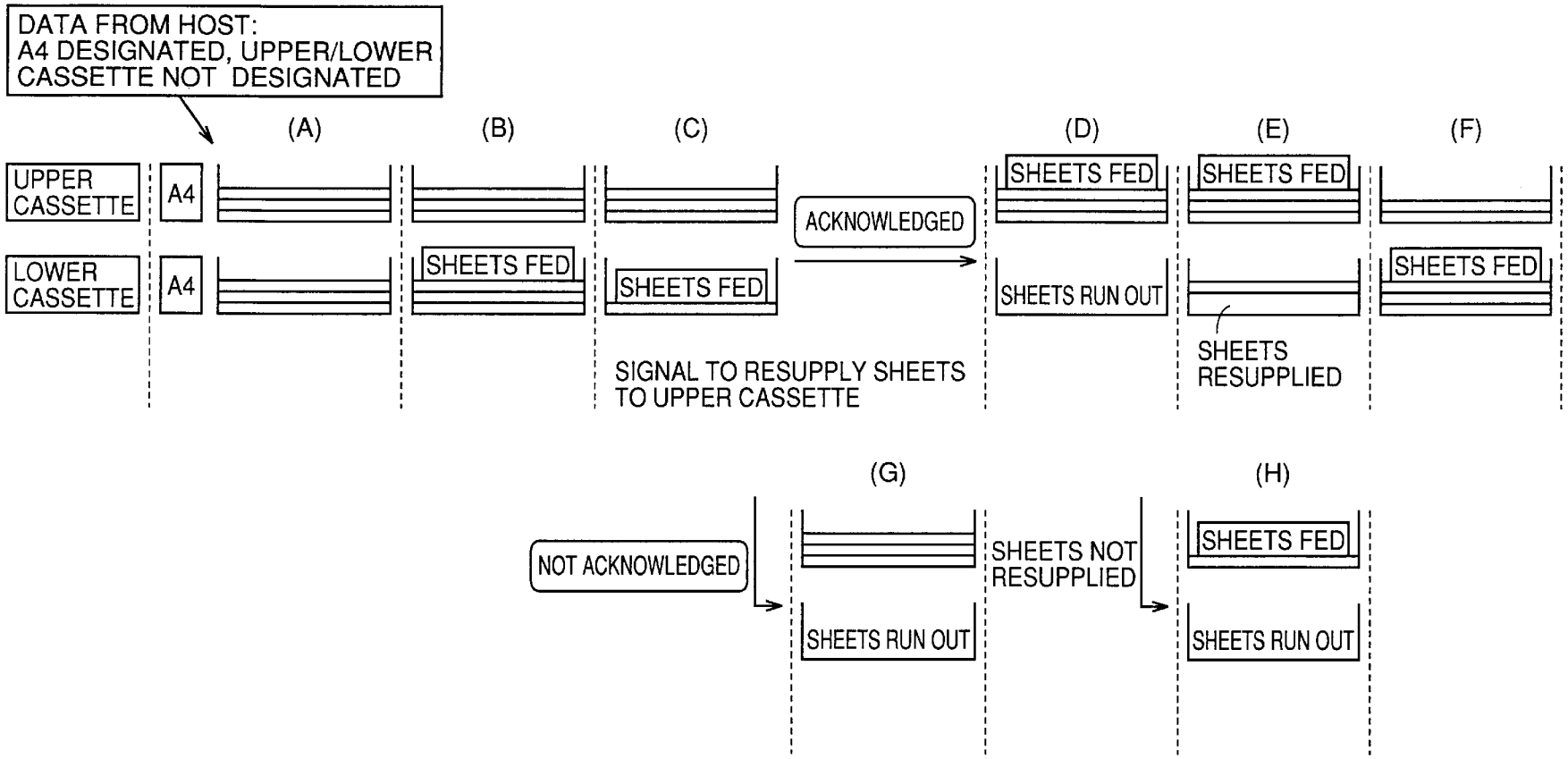
FIG. 3 illustrates a sheet-feeding state of a first operation example of the laser printer as the embodiment of the present invention.

A first operation example thereof will now be described with reference to FIG. 3.

The upper and lower sheet feeding cassettes 8 and 11 are both of a size of A4 with more than a predetermined number of sheets set therein while host computer 21 transmits data of a size of A4 without upper/lower cassette designation (FIG. 3(A)). Since the image data (printed data) is the same in size as the upper and lower cassettes and the upper and lower cassettes both sufficiently contains sheets, lower sheet feeding cassette 11 first starts to feed sheets (FIG. 3(B)). When lower sheet feeding cassette 11 continues to feed sheets and the number of the sheets remaining in lower sheet feeding cassette 11 is no more than a predetermined number (predetermined value n), a signal is transmitted indicating that upper sheet feeding cassette 8 feeds sheets when the lower cassette runs out of sheets (FIG. 3(C)). If in this state (FIG. 3(C)) the user indicates via operation key 27 his/her acknowledgement that the upper sheet feeding cassette 8 feeds sheets, upper sheet feeding cassette 8 starts to feed sheets successively after lower sheet feeding cassette 11 runs out of sheets. Simultaneously a request is signaled to resupply sheets to lower sheet feeding cassette 11 (FIG. 3(D)).

When lower sheet feeding cassette 11 is then resupplied with sheets (FIG. 3(E)), lower sheet feeding cassette 11 then again starts to feed sheets (FIG. 3(F)). Thereafter, the operations illustrated in FIG. 3(A) to 3(F) can be repeated to successively effect image forming operations until upper and lower sheet feeding cassettes 8 and 11 run out of sheets.

If lower sheet feeding cassette 11 runs out of sheets without the FIG. 3(C) acknowledgement from the user that upper sheet feeding cassette 8 feeds sheets, a signal indicating that lower sheet feeding cassette 11 runs out of sheets is transmitted when cassette 11 runs out of sheets, to interrupt the current image forming operation (FIG. 3(G)).

If lower sheet feeding cassette 11 is not resupplied with sheets after the signaling of the request to resupply sheets to lower sheet feeding cassette 11 in the FIG. 3(D) state and the number of the sheets stored in upper sheet feeding cassette 8 is meanwhile reduced to no more than the predetermined number, the request is again signaled to resupply sheets to lower sheet feeding cassette 11 (FIG. 3(H)).

Figure 4:
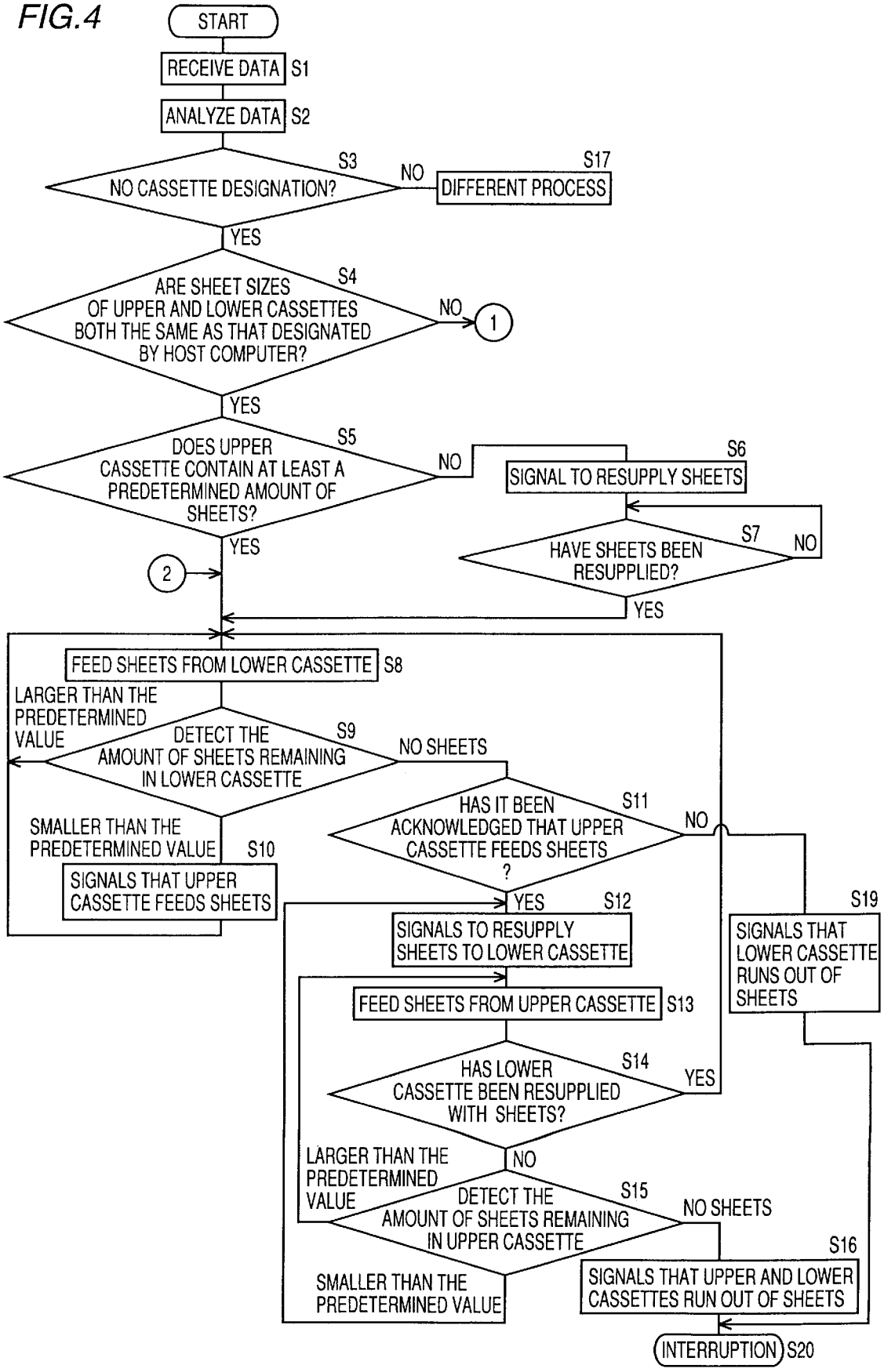
FIG. 4 is a flow chart of the first operation example of the laser printer as the embodiment of the present invention.

Referring to FIG. 4, each portion of the laser printer operates as follows: ICU 22 receives data from host computer 21 (S1). ICU 22 analyzes the data (S2). ICU 22 determines whether the data received from host computer 21 also designates which cassette to feed sheets (S3). If there is not such a destination (YES at S3), ICU 22 determines whether the size of the sheets in upper cassette 8 and that of the sheets in lower cassette 11 and that of a sheet designated by host computer 21 are all the same (S4). The process effected when the sizes are not the same (NO at S4) will be described hereinafter.

When the sizes are all the same (YES at S4), PCU 24 determines whether more than a predetermined number of sheets are stored in upper cassette 8 (S5). If less than the predetermined number of sheets are stored in upper cassette 8 (NO at S5), PCU 24 signals a request to resupply sheets to upper cassette 8 (S6). PCU 24 determines whether upper cassette 8 has been resupplied with sheets (S7). If upper cassette 8 has been resupplied with sheets or if any indication is not provided when a predetermined time elapses (YES at S7), electrophotography processing portion 23 allows lower cassette 11 to feed sheets (S8). If PCU 24 determines in the process at S5 that upper cassette 8 contains more than the predetermined number of sheets (YES at S5), lower cassette 11 also feeds sheets similarly (S8). PCU 24 detects the amount of the sheets remaining in lower cassette 11 (S9). If the lower cassette 11 still contains more than the predetermined number of sheets (i.e. when the number of the sheets remaining in lower cassette 11 is larger than the predetermined number at S9), lower cassette 11 successively feeds sheets (S8). When the amount of the sheet stored in lower cassette 11 is reduced to less than the predetermined number (i.e. when the amount of the sheets remaining in lower cassette 11 is smaller than the predetermined value at S9), PCU 24 signals that upper cassette 8 feeds sheets when lower cassette 11 runs out of sheets (S10). In response to the signaling, the user operates operation key 27 to indicate his or her acknowledgement. Then the process is returned to S8 and lower cassette 11 feeds sheets. When lower cassette 11 runs out of sheets (when sheets run out at S9), PCU 24 determines whether the user has acknowledged that upper cassette 8 feeds sheets (S11). If the user has acknowledged accordingly (YES at S11), PCU 24 signals a request to resupply sheets to lower cassette 11(S12). Electrophotography processing portion 23 causes upper cassette 8 to start feeding sheets (S13).

PCU 24 determines whether lower cassette 11 has been resupplied with sheets (S14). If it has been resupplied with them (YES at S14), electrophotography processing portion 23 allows lower cassette 11 to feed sheets (S8). If it has not been supplied with sheets (NO at S14), PCU 24 detects the amount of the sheets remaining in upper cassette 8 (S15). If the amount of the sheets remaining in upper cassette 8 exceeds the predetermined value (i.e. the amount of the sheets remaining in upper cassette 8 is larger than the predetermined value at S15), PCU 24 returns the process to S13 and upper cassette 8 feeds sheets. If the amount of the sheets remaining in upper cassette 8 is below the predetermined value (i.e. the amount of the sheets remaining in upper cassette 8 is smaller than the predetermined value at S15), PCU 24 returns the process to S 12 and PCU 24 signals a request to resupply lower cassette 11 with sheets. When upper cassette 8 runs out of sheets (i.e. when sheets run out at S15), PCU 24 signals that upper and lower cassettes 8 and 11 run out of sheets (S16) and interrupts the current image forming operation (a printing operation) (S20).

If the user fails to acknowledge that upper cassette 8 feeds sheets (NO as S11), PCU 24 signals that lower cassette 11 runs out of sheets and interrupts the current image forming operation (S20).

Thus, upper cassette 8 previously supplied with sufficient sheets, and a request signaled to rapidly supply sheets to lower cassette 11 when lower cassette 11 runs out of sheets, allow successive image formation.

A second operation example (the process after NO at S4 of FIG. 4) will now be described with reference to FIG. 5.

Assuming that upper and lower cassettes 8 and 11 are respectively A4 and B5-sized cassettes, each having at least the predetermined number of sheets set therein, and that host computer 21 transmits data of a size of A4 without upper/lower cassette designation (FIG. 5(A)), sheet feeding is started from upper cassette 8 containing sheets of the same size as the size designated by host computer 21. Simultaneously a signal is transmitted to change the size of lower cassette 11 from B5 to A4 and resupply sheets to lower cassette 11 (FIG. 5(B)). After the signaling, lower cassette 11 feeds sheets (FIG. 5(D)) when the size of the lower cassette 11 is changed to A4 (FIG. 5(C)).

Figure 5:
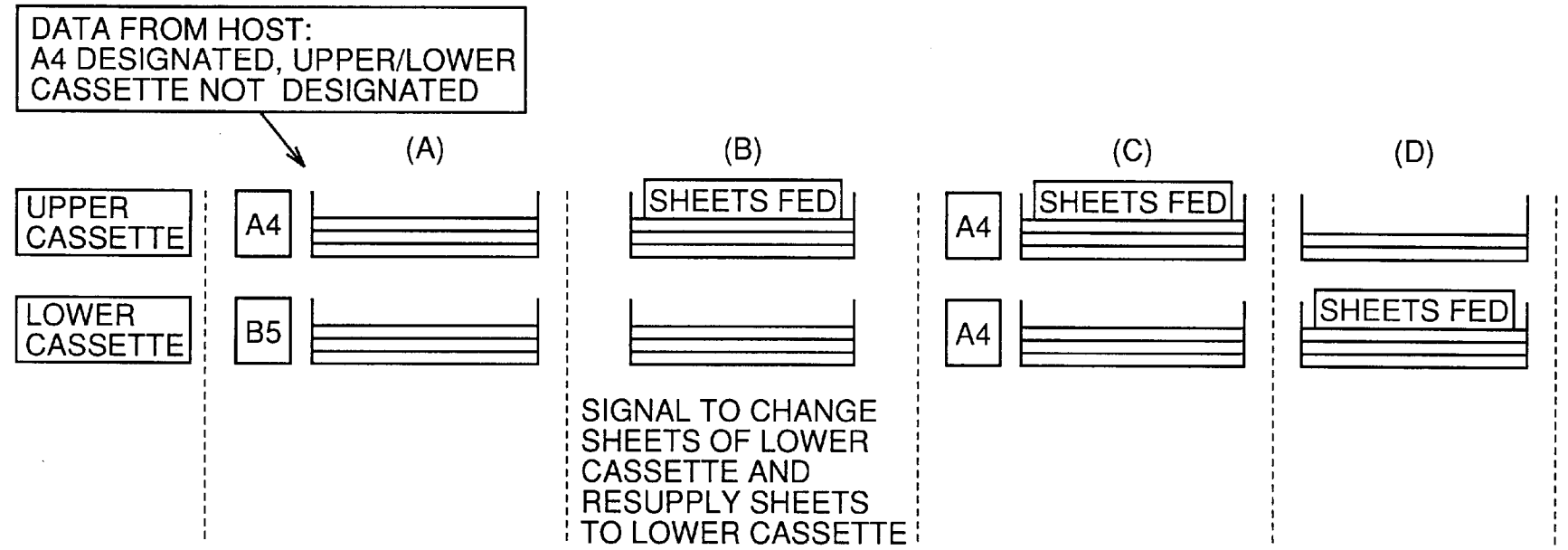
FIG. 5 illustrates a sheet-feeding state of a second operation example of the laser printer as the embodiment of the present invention.

The condition shown in FIG. 5 (D) is similar to that shown in FIG. 3(B). Thus, thereafter the subsequent operation can be effected according to the corresponding operation of the first operation example to allow sheets to be fed successively.

Figure 6:
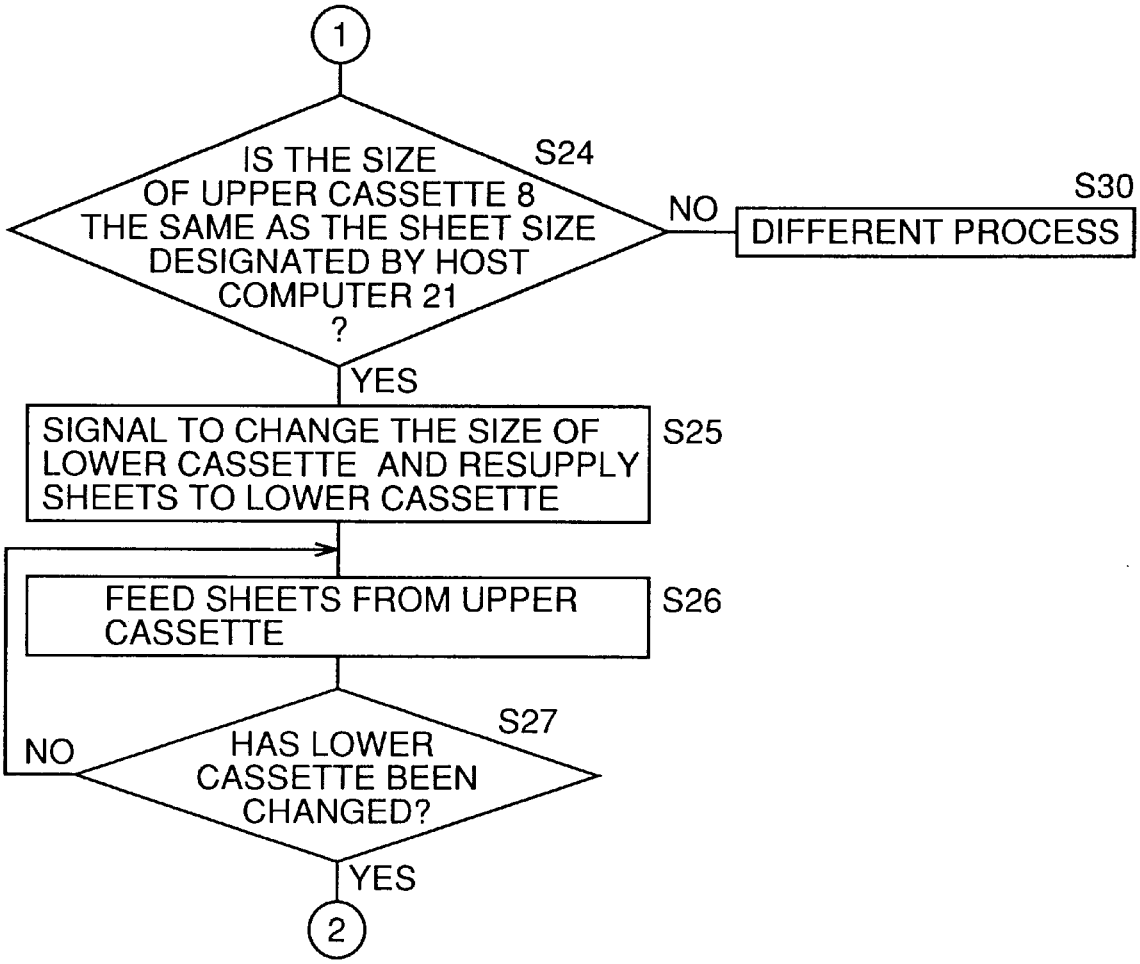
FIG. 6 is a flow chart of the second operation example of the laser printer as the embodiment of the present invention.

The series of operations described above will be described with reference to FIGS. 4 and 6. In the condition shown in FIG. 5(A), decision is made in the process at S4 of FIG. 4 that not all of the sheet sizes of the cassettes are the same as the sheet size designated by host computer 21 (NO at S4 of FIG. 4). Thus the process is shifted to S24 of FIG. 6 and PCU 24 determines whether the size of the upper cassette 8 is the same as the sheet size designated by host computer 21 (S24). If the size of upper cassette 8 is not the same as the sheet size designated by host computer 21 (NO at S24), a different process is effected (S30).

If the size of upper cassette 8 rather than that of lower cassette 11 is the same as the sheet size designated by host computer 21 (YES at S24), the process is shifted to S25 at which PCU 24 signals a request to replace lower cassette 11 with a cassette of the size designated by host computer 21.

Then, electrophotography processing portion 23 allows upper cassette 8 to feed sheets (S26). PCU 24 determines whether lower cassette 11 has been replaced with a cassette of the size requested by host computer 21 (S27). If it has not been replaced with a cassette of the size requested by host computer 21 (NO at S27), electrophotography processing portion 23 allows upper cassette 8 to continue to feed sheets (S26).

When lower cassette 11 is replaced with a cassette of the size requested by host computer 21 (YES at S27), the process is shifted to S8 of FIG. 4 and electrophotography processing portion 23 allows lower cassette 11 to feed sheets. Then, the process subsequent to S9 of FIG. 4 is effected, as is similar to the first operation example.

Thus the laser printer according to the present embodiment allows upper cassette 8 to feed sheets when lower cassette 11 runs out of sheets. The laser printer signals to the operator a request to resupply sheets to lower cassette 11 while upper cassette 8 is feeding sheets. When lower cassette 11 is resupplied with sheets, the cassette for supplying sheets is switched from upper cassette 8 to lower cassette 11 and lower cassette 11 thus again feeds sheets. Thus feeding sheets from lower cassette 11 is prioritized, and a request to resupply sheets to lower cassette 11 is signaled to the operator when lower cassette 11 is allowed to be resupplied with sheets. Thus, sheets can be successively fed until upper and lower cassettes 8 and 11 completely run out of sheets. Furthermore, the operator can rapidly resupply sheets to lower cassette 11.

When image data is the same in size as upper cassette 8 rather than lower cassette 11, upper cassette 8 feeds sheets. Simultaneously a request is signaled to replace lower cassette 11 with a cassette of the same size as the image data. When lower cassette 11 is replaced with a cassette of an appropriate size, lower cassette 11 feeds sheets. Since a request to change lower cassette 11 is signaled when lower cassette 11 is allowed to be changed, the laser printer can feed sheets successively.

With lower cassette 11 containing an amount of sheets that is lower than a predetermined value, the laser printer signals that upper cassette 8 feeds sheets when lower cassette 11 runs out of sheets. If the operator acknowledges via operation key 27 that upper cassette 8 feeds sheets, upper cassette 8 feeds sheets. If the operator fails to acknowledge that upper cassette 8 feeds sheets, the current image forming operation is stopped when lower cassette 11 runs out of sheets.

If the operator acknowledges that upper cassette 8 feeds sheets, the operator can resupply lower cassette 11 with sheets when lower cassette 11 runs out of sheets. When lower cassette 11 is resupplied with sheets, lower cassette 11 starts feeding sheets. The shorter the time required for resupplying sheets to lower cassette 11, the less sheets are fed from upper cassette 8. This increases the number of sheets that can be fed successively.

Before the laser printer allows lower cassette 11 to feed sheets, the laser printer detects the amount of the sheets remaining in upper cassette 8. If upper cassette 8 contains an amount of sheets that is lower than a predetermined value, the laser printer signals a request to resupply sheets to upper cassette 8. The laser printer allows lower cassette 11 to feed sheets. When lower cassette 11 runs out of sheets, the laser printer allows upper cassette 8 to feed sheets. When lower cassette 11 is resupplied with sheets with upper cassette 8 feeding sheets, lower cassette 11 resumes feeding sheets. However, while lower cassette 11 is feeding sheets, the user cannot resupply sheets to upper cassette 8. Accordingly, an adequate number of sheets previously stored in upper cassette 8 allows an increased number of sheets that can be fed successively.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method to feed sheets for use in an image formation apparatus including first and second sheet storage means each for storing said sheets, first and second detection means for respectively detecting an amount of said sheets remaining in said first sheet storage means and an amount of said sheets remaining in said second sheet storage means, image formation means for forming an image on said sheets, so that said sheets can come from either said first sheet storage means or said second sheet storage means, indication means for signaling a request to an operator and receiving an indication from said operator, and control means for control of selecting one of said first and second sheet storage means and feeding said sheets stored in the selected sheet storage means to said image formation means, wherein said second sheet storage means cannot be resupplied with said sheets while said first sheet storage means feeds said sheets stored in said first sheet storage means to said image formation means, the sheet feeding method comprising the steps of:

allowing said first sheet storage means to feed said sheets when said sheets respectively stored in said first and second sheet storage means both have a same size as said image;

signaling an initial request to resupply said sheets to said first sheet storage means and allowing said second sheet storage means to feed said sheets when said first sheet storage means runs out of said sheets;

again allowing said first sheet storage means to feed said sheets when said first sheet storage means is resupplied with said sheets after the step of signaling a request to resupply said sheets to said first sheet storage means; and resignaling another request to resupply said sheets to the first sheet storage means, when despite of the initial request to resupply said sheets to the first sheet storage means having been signaled, the first sheet storage means is not resupplied with said sheets and the second sheet storage means also contains sheets of less than a predetermined amount.

2. The method to feed sheets according to claim 1, further comprising the step of signaling a request to replace said sheets stored in said first sheet storage means with said sheets of a same size as said image and allowing said second sheet storage means to feed said sheets stored within the second storage means when said image has the same size as said sheets stored in said second sheet storage means rather than said sheets stored in said first sheet storage means, and allowing said first sheet storage means to feed said sheets stored within the first storage means when said first sheet storage means is resupplied with said sheets of the same size as said image.

3. The method to feed sheets according to claim 1, further comprising the steps of:

signaling that said second sheet storage means feeds said sheets stored within said second storage means when said first sheet storage means runs out of said sheets stored within said first storage means;

requesting an acknowledgement from an operator when said sheets stored in said first sheet storage means is reduced to less than a predetermined amount with said first sheet storage means feeding said sheets stored within said first sheet storage means; and allowing said second sheet storage means to feed said sheets stored within said second sheet storage means when said first sheet storage means runs out of said sheets stored within first sheet storage means, if said operator has acknowledged via said indication means that said second sheet storage means feeds said sheets.

4. The method to feed sheets according to claim 1, wherein the step of allowing said first sheet storage means to feed said sheets stored within said first sheet storage means when said sheets respectively stored in said first and second sheet storage means both have a same size as said image includes the steps of:

determining whether said second sheet storage means contains at least the predetermined amount of said sheets when said sheets respectively stored in said first and second sheet storage means both have the same size as said image;

signaling to resupply said sheets to said second sheet storage means when said second sheet storage means contains less than the predetermined amount of said sheets;

determining whether said second sheet storage means has been resupplied with said sheets; and allowing said first sheet storage means to feed said sheets stored within said first sheet storage means when said second sheet storage means is resupplied with said sheets, a predetermined period of time elapses after the step of signaling to resupply said sheets to said second sheet storage means, or when decision is made that said second sheet storage means contains at least the predetermined amount of said sheets.

5. A method to feed sheets for use in an image formation apparatus including first and second sheet storage means each for storing said sheets, first and second detection means for respectively detecting an amount of said sheets remaining in said first sheet storage means and an amount of said sheets remaining in said second sheet storage means, image formation means for forming an image on said sheets, so that said sheets can come from either said first sheet storage means or said second sheet storage means, indication means for signaling a request to an operator and receiving an indication from said operator, and control means for control of selecting one of said first and second sheet storage means and feeding said sheets stored in the selected sheet storage means to said image formation means, wherein said second sheet storage means cannot be resupplied with said sheets while said first sheet storage means feeds said sheets to said image formation means, the sheet feeding method comprising the steps of:

allowing said first sheet storage means to feed said sheets when said sheets respectively stored in said first and second sheet storage means both have a same size as said image;

signaling a request to resupply said sheets to said first sheet storage means and allowing said second sheet storage means to feed said sheets when said first sheet storage means runs out of said sheet;

again allowing said first sheet storage means to feed said sheets stored in said first sheet storage means when said first sheet storage means is resupplied with said sheets after the step of signaling a request to resupply said sheets to said first sheet storage means;

signaling a request to replace said sheets stored in said first sheet storage means with said sheets of a same size as said image and allowing said second sheet storage means to feed said sheets stored within the second storage means when said image has the same size as said sheet stored in said second sheet storage means rather than said sheet stored in said first sheet storage means; and allowing said first sheet storage means to feed said sheets stored within the first storage means when said first sheet storage means is resupplied with said sheets of the same size as said image, wherein the step of allowing said first sheet storage means to feed said sheets contained within said first sheet storage means when said sheets respectively stored in said first and second sheet storage means both have a same size as said image includes the steps of:

determining whether said second sheet storage means contains at least the predetermined amount of said sheets when said sheets respectively stored in said first and second sheet storage means both have the same size as said image;

signaling to resupply said sheets to said second sheet storage means when said second sheet storage means contains less than the predetermined amount of said sheets;

determining whether said second sheet storage means has been resupplied with said sheets; and allowing said first sheet storage means to feed said sheets contained within said first sheet storage means when said second sheet storage means is resupplied with said sheets, a predetermined period of time elapses after the step of signaling to resupply said sheets to said second sheet storage means, or when decision is made that said second sheet storage means contains at least the predetermined amount of said sheets.

6. A method to feed sheets for use in an image formation apparatus including first and second sheet storage means each for storing said sheets, first and second detection means for respectively detecting an amount of said sheets remaining in said first sheet storage means and an amount of said sheets remaining in said second sheet storage means, image formation means for forming an image on said sheets, so that said sheets can come from either said first sheet storage means or said second sheet storage means, indication means for signaling a request to an operator and receiving an indication from said operator, and control means for control of selecting one of said first and second sheet storage means and feeding said sheets stored in the selected sheet storage means to said image formation means, wherein said second sheet storage means cannot be resupplied with said sheets while said first sheet storage means feeds said sheets to said image formation means, the sheet feeding method comprising the steps of:

allowing said first sheet storage means to feed said sheets when said sheets respectively stored in said first and second sheet storage means both have a same size as said image;

signaling a request to resupply said sheets to said first sheet storage means and allowing said second sheet storage means to feed said sheets when said first sheet storage means runs out of said sheet;

again allowing said first sheet storage means to feed said sheets stored in said first sheet storage means when said first sheet storage means is resupplied with said sheets after the step of signaling a request to resupply said sheets to said first sheet storage means; and signaling that said second sheet storage means feeds said sheets stored within said second sheet storage means when said first sheet storage means runs out of said sheets and requesting an acknowledgement from an operator when said sheets stored in said first sheet storage means is reduced to less than a predetermined amount with said first sheet storage means feeding said sheets contained within said first sheet storage means; and allowing said second sheet storage means to feed said sheets contained within said second sheet storage means when said first sheet storage means runs out of said sheets contained within said first sheet storage means, if said operator has acknowledged via said indication means that said second sheet storage means feeds said sheets contained within said second sheet storage means.

7. The method to feed sheets according to claim 6, wherein the step of initially allowing said first sheet storage means to feed said sheets contained within said first sheet storage means when said sheets respectively stored in said first and second sheet storage means both have a same size as said image includes the steps of determining whether said second sheet storage means contains at least the predetermined amount of said sheets when said sheets respectively stored in said first and second sheet storage means both have the same size as said image;

signaling to resupply said sheets to said second sheet storage means when said second sheet storage means contains less than the predetermined amount of said sheets;

determining whether said second sheet storage means has been resupplied with said sheets; and allowing said first sheet storage means to feed said sheets contained within said first sheet storage means when said second sheet storage means is resupplied with said sheets, a predetermined period of time elapses after the step of signaling to resupply said sheets to said second sheet storage means, or when decision is made that said second sheet storage means contains at least the predetermined amount of said sheets.

8. A method to feed sheets for use in an image formation apparatus including first and second sheet storage means each for storing said sheets, first and second detection means for respectively detecting an amount of said sheets remaining in said first sheet storage means and an amount of said sheets remaining in said second sheet storage means, image formation means for forming an image on said sheets, so that said sheets can come from either said first sheet storage means or said second sheet storage means, indication means for signaling a request to an operator and receiving an indication from said operator, and control means for control of selecting one of said first and second sheet storage means and feeding said sheets stored in the selected sheet storage means to said image formation means, wherein said second sheet storage means cannot be resupplied with said sheets while said first sheet storage means feeds said sheets to said image formation means, the sheet feeding method comprising the steps of:

allowing said first sheet storage means to feed said sheets when said sheets respectively stored in said first and second sheet storage means both have a same size as said image;

signaling a request to resupply said sheets to said first sheet storage means and allowing said second sheet storage means to feed said sheets when said first sheet storage means runs out of said sheet; and again allowing said first sheet storage means to feed said sheets stored in said first sheet storage means when said first sheet storage means is resupplied with said sheets after the step of signaling a request to resupply said sheets to said first sheet storage means, wherein the step of allowing said first sheet storage means to feed said sheets contained within said first sheet storage means when said sheets respectively stored in said first and second sheet storage means both have a same size as said image includes the steps of: determining whether said second sheet storage means contains at least the predetermined amount of said sheets when said sheets respectively stored in said first and second sheet storage means both have the same size as said image; signaling to resupply said sheets to said second sheet storage means when said second sheet storage means contains less than the predetermined amount of said sheets;

determining whether said second sheet storage means has been resupplied with said sheets; and allowing said first sheet storage means to feed said sheets contained within said first sheet storage means when said second sheet storage means is resupplied with said sheet, a predetermined period of time elapses after the step of signaling to resupply said sheets to said second sheet storage means, or when decision is made that said second sheet storage means contains at least the predetermined amount of said sheets.

9. A method to feed sheets for use in an image formation apparatus including first and second sheet storage means each for storing said sheets, first and second detection means for respectively detecting an amount of said sheets remaining in said first sheet storage means and an amount of said sheets remaining in said second sheet storage means, image formation means for forming an image on said sheets, so that said sheets can come from either said first sheet storage means or said second sheet storage means, indication means for signaling a request to an operator and receiving an indication from said operator, and control means for control of selecting one of said first and second sheet storage means and feeding said sheets stored in the selected sheet storage means to said image formation means, wherein said second sheet storage means cannot be resupplied with said sheets while said first sheet storage means feeds said sheets contained within said first sheet storage means to said image formation means, the sheet feeding method comprising the steps of:

signaling an initial request to replace said sheets stored in said first sheet storage means with sheets of a same size as said image and allowing said second sheet storage means to feed said sheets contained within said second sheet storage means when said image has a same size as said sheets stored in said second sheet storage means rather than said sheets stored in said first sheet storage means, and allowing said first sheet storage means to feed said sheets stored within said first sheet storage means when said first sheet storage means is resupplied with said sheets of the same size as said image;

allowing said second sheet storage means to feed said sheets stored within said second sheet storage means when said first sheet storage means runs out of said sheets stored within said sheet storage means;

again allowing said first sheet storage means to feed said sheets stored within said first sheet storage means when said first sheet storage means is resupplied with said sheets; and resignaling another request to resupply said sheets to the first sheet storage means, when despite of the initial request to resupply said sheets to the first sheet storage means having been signaled, the first sheet storage means is not resupplied with said sheets and the second sheet storage means also contains sheets of less than a predetermined amount.

10. A method to feed sheets for use in an image formation apparatus including first and second sheet storage means each for storing said sheets, first and second detection means for respectively detecting an amount of said sheets remaining in said first sheet storage means and an amount of said sheets remaining in said second sheet storage means, image formation means for forming an image on said sheets, so that said sheets can come from either said first sheet storage means or said second sheet storage means, indication means for signaling a request to an operator and receiving an indication from said operator, and control means for control of selecting one of said first and second sheet storage means and feeding said sheets stored in the selected sheet storage means to said image formation means, wherein said second sheet storage means cannot be resupplied with said sheets while said first sheet storage means feeds said contained within said first sheet storage means to said image formation means, the sheet feeding method comprising the steps of:

signaling a request to replace said sheets stored in said first sheet storage means with sheets of a same size as said image and allowing said second sheet storage means to feed said sheets contained within said second sheet storage means when said image has a same size as said sheets stored in said second sheet storage means rather than said sheets stored in said first sheet storage means, and allowing said first sheet storage means to feed said sheets stored within said first sheet storage means when said first sheet storage means is resupplied with said sheets of the same size as said image;

allowing said second sheet storage means to feed said sheets stored within said second sheet storage means when said first sheet storage means runs out of said sheets stored within said sheet storage means; and again allowing said first sheet storage means to feed said sheets stored within said first sheet storage means when said first sheet storage means is resupplied with said sheets;

signaling that said second sheet storage means feeds said sheets stored within said second sheet storage means when said first sheet storage means runs out of said sheets stored within said first sheet storage means and requesting an acknowledgement from an operator when said sheets stored in said first sheet storage means is reduced to less than a predetermined amount with said first sheet storage means feeding said sheets stored within said first sheet storage means;

terminating a process when said first sheet storage means runs out of said sheets stored within said first sheet storage means, if said operator has failed to acknowledge via said indication means that said second sheet storage means feeds said sheets stored within said second sheet storage means; and allowing said second sheet storage means to feed said sheets stored within said second sheet storage means when said first sheet storage means runs out of said sheets stored within said first said sheet storage means, if said operator has acknowledged via said indication means that said second sheet storage means feeds said sheets stored within said second sheet storage means.

11. A method to feed sheets for use in an image formation apparatus including first and second sheet storage means each for storing a sheets, first and second detection means for respectively detecting an amount of said sheets remaining in said first sheet storage means and an amount of said sheets remaining in said second sheet storage means, image formation means for forming an image on said sheets, so that said sheets can come from either said first sheet storage means or said second sheet storage means, indication means for signaling a request to an operator and receiving an indication from said operator, and control means for control of selecting one of said first and second sheet storage means and feeding said sheets stored in the selected sheet storage means to said image formation means, wherein said second sheet storage means cannot be resupplied with said sheets while said first sheet storage means feeds said sheets stored within said first sheet storage means to said image formation means, the sheet feeding method comprising the steps of:

determining whether said second sheet storage means contains at least a predetermined amount of said sheets when said sheets respectively stored in said first and second sheet storage means both have a same size as said image;

signaling to resupply said sheets to said second sheet storage means when said second sheet storage means contains less than the predetermined amount of said sheets;

determining whether said second sheet storage means has been resupplied with said sheets;

allowing said first sheet storage means to feed said sheets stored within said first sheet storage means when said second sheet storage means is resupplied with said sheets, a predetermined period of time elapses after the step of signaling to resupply said sheets to said second sheet storage means, or when decision is made that said second sheet storage means contains at least the predetermined amount of said sheets;

allowing said second sheet storage means to feed said sheets stored within said second sheet storage means when said first sheet storage means runs out of said sheets stored within said first sheet storage means; and again allowing said first sheet storage means to feed said sheets stored within said first sheet storage means when said first sheet storage means is resupplied with said sheets.

* * * * *